United States Patent [19]

Phelps

[11] 4,020,855

[45] May 3, 1977

[54] HAIR CURLER HAVING INTEGRAL RETAINER

[76] Inventor: Robert H. Phelps, 205 Irene Drive, Vernon, Conn. 06066

[22] Filed: Nov. 13, 1975

[21] Appl. No.: 631,671

[52] U.S. Cl. ..... 132/40

[51] Int. Cl.[2] ..... A45D 2/00

[58] Field of Search ..... 132/40, 42, 41, 39, 132/9

[56] References Cited

UNITED STATES PATENTS

| | | | |
|---|---|---|---|
| 2,793,645 | 5/1957 | Grant | 132/42 R |
| 2,811,973 | 11/1957 | Pileggi et al. | 132/42 R |
| 3,019,798 | 2/1962 | Gaget | 132/42 R |

*Primary Examiner*—G. E. McNeill
*Attorney, Agent, or Firm*—McCormick, Paulding & Huber

[57] ABSTRACT

A hair curler is provided with pivotally mounted retaining arms at each end of a perforated, cylindrical body for capturing a tress of hair rolled onto the body. The retaining arms are supported at the respective ends of the body by means of pivotal bails which permit the arms to be swung over either of two diametrically opposite sides of the curler in positions generally parallel to the longitudinal axis of the body. Snap catches connected to the retaining arms engage perforations in the body to hold the arms in positions capturing the tress of hair.

11 Claims, 3 Drawing Figures

HAIR CURLER HAVING INTEGRAL RETAINER

BACKGROUND OF THE INVENTION

The present invention relates to a hair curler for setting and holding a tress of hair and the curler includes integrally connected retaining arms to facilitate the setting process.

In prior art hair curlers, such as shown in U.S. Pat. No. 3,439,686, issued Klink, it is common to find a perforated cylindrical body around which a tress of hair is rolled or wound during a setting operation. To hold the curler and hair in place, a separate clip or retainer is placed in clamping relationship with the cylindrical body and hair. Because of the separability of the retainer and cylindrical body, the hair setting operation is rendered more cumbersome and inefficient. Two hands are required to roll the tress of hair onto the curler and then the curler with the tress thereon must be held in place while the retainer is first located on a nearby stand, then picked up and placed in clamping relationship with the hair and cylindrical body.

A more efficient hair curler is formed when the clip or retainer is integrally connected with the curler as shown, for example, in U.S. Pat. No. 3,291,142, issued to Green et al and U.S. Pat. No. 3,470,888 issued to Kuhn. With such a curler, the operation of rolling a tress around the cylindrical body and then securing the curler in place may be executed sequentially without interruptions to search for and pick up the retainer before it is installed on the curler body.

It is desirable with hair curlers having integrally connected retainers to position the retainers in unobstructing locations when the tress of hair is rolled onto the cylindrical body of the curler and such positioning in some of the prior art curlers is not possible in view of the size of the retainers and the manner in which the retainers are mounted on the cylindrical body. It will be understood that a curler having a long retaining arm pivotally connected to one end of the curler can easily interfere with the hands or hair as the tress is rolled onto the cylindrical body. On the other hand, if the retaining arm is located in such a manner that it does not interfere with the hands or hair, then the arm may be difficult to reach and position in clamping relationship on the tress when needed. Hence, a curler having an integral retainer should be designed in a manner which most efficiently facilitates rolling the tress onto the body of the curler and positioning the retainer in clamping relationship immediately thereafter.

Accordingly, it is a general object of the present invention to provide a hair curler of efficient design to facilitate the hair setting process.

SUMMARY OF THE INVENTION

The present invention relates to a hair curler having an integrally connected retaining arm which facilitates the hair setting process.

The curler includes a hollow, perforated cylindrical body onto which a tress of hair is rolled or wound between opposite axial ends of the body. Preferably the body is made of molded plastic for light-weight and corrosion-resistant properties. The perforations extend radially through the body to permit more rapid drying of the set hair and also contribute to a light-weight design.

A retaining arm for capturing a tress of hair rolled onto the cylindrical body is connected to one axial end of the body by means of a pivotal bail. The bail is permitted to swivel between a first position extending axially of the one end of the body and a second position angularly disposed to the axis of the body. In a preferred embodiment of the invention, the bail has an arcuate configuration and is connected to the outer surface of the cylindrical body at the one end so that the bail can swing from the axially extending position 90° toward one side or the other of the cylindrical body.

The retaining arm mounted on the bail extends over the perforated cylindrical body generally parallel to the longitudinal axis of the body when the bail is in the second position. Preferably, the bail holds the retaining arm in spaced relationship to the cylindrical body so that the captured tress of hair is not crushed.

Means are provided for holding the retaining arm when the tress of hair is captured on the curler and in a preferred embodiment, the holding means is formed by a catch which snaps through one of the perforations of the cylindrical body.

By mounting a retaining arm on a bail at each axial end of the curler body, the retaining arms can be swung into positions adjacent the axial ends while hair is rolled onto the cylindrical curler body. The arms can thereafter be snapped into clamping relationship on the hair with ease. Thus, hair may be set efficiently and without the complications of certain prior art curlers.

DESCRIPTION OF THE PREFERRED EMBODIMENTS

Figure 1:
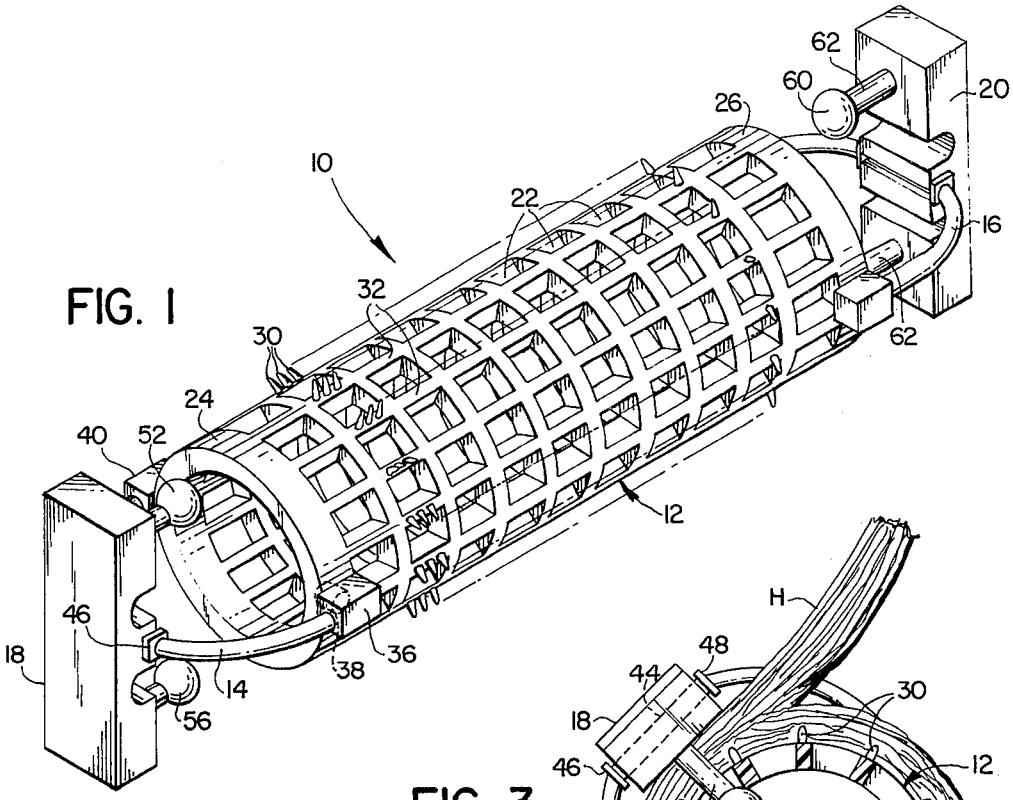
FIG. 1 is a perspective view showing the hair curler of the present invention.

FIG. 1 illustrates the hair curler, generally designated 10, of the present invention in a preferred embodiment. The curler 10 is comprised principally of a perforated cylindrical body 12, two bails 14 and 16 at opposite axial ends of the body 12 and two retaining arms 18 and 20 mounted respectively on the bails. Although it is not essential, each of the parts can be formed in a plastic injection molding process for light-weight, corrosion-resistant properties and economical production in large volume. It will be understood that in view of the exposure of the curler to water, soaps, tints, and various types of hair sprays, the plastic construction utilizing polyvinylchloride, polypropylene, or similar materials is preferred. It is recognized, however, that certain corrosion-resistant metals may be substituted if desired provided that the light-weight feature of plastic is not significantly affected.

The body 12 is conventional to the extent that it has a cylindrical form and the cylindrical walls are fabricated with a plurality of perforations 22 extending radially through the body from the outer cylindrical surface to the hollow interior. The perforations cover a large portion of the body to allow damp hair rolled on the body to be dried by means of air which circulates through the open axial ends 24 and 26 of the body. The perforations also contribute to the light-weight property of the body without significantly destroying the body strength.

The body 12 may also be provided with rows of teeth 30 which project radially from longitudinally extending columns 32 interposed between adjacent rows of perforations 22. The teeth 30 aid in holding the tress of hair on the body at each longitudinal station of the body and also prevent the body from turning and unrolling a tress of hair wound around the body as shown in FIG. 3.

In accordance with the present invention, the retaining arms 18 and 20 are mounted at opposite ends 24 and 26 of the cylindrical body 12 by means of the bails 14 and 16 respectively. Since the bails and arms at each end of the body 12 are identical, only the arm 18 and the bail 14 are described in detail below and illustrated in FIG. 2 and 3. However, the statements made with regard to the bail 14 and arm 18 apply equally to the bail 16 and arm 20.

Figure 3:
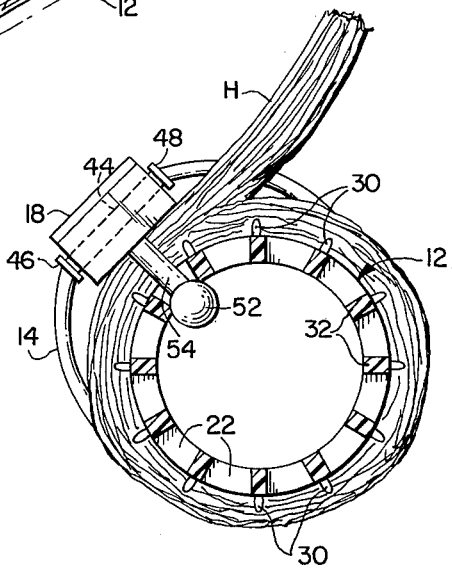
FIG. 3 is a sectional view of the curler as viewed along the sectioning line 3—3 in FIG. 2.
Figure 2:
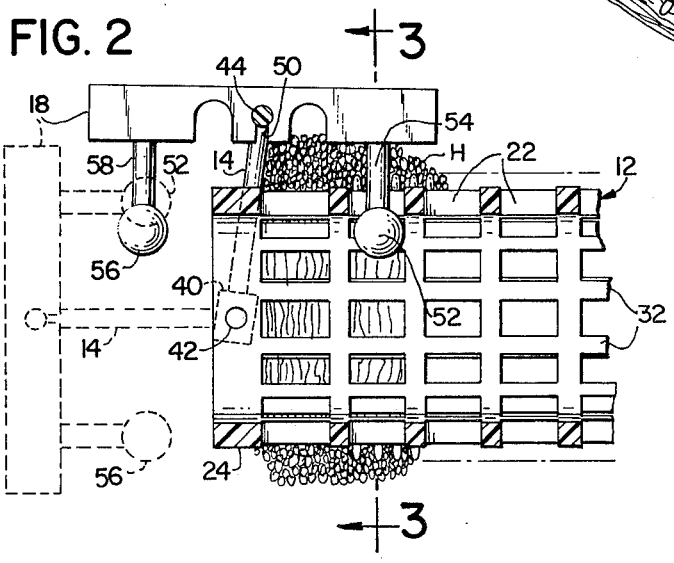
FIG. 2 is a longitudinal section through one end of the hair curler and shows the retaining arm in one position capturing a tress of hair and a phantom position permitting the hair to be wound onto the curler body.

As shown in the FIGS. 1–3, the bail 14 has a generally arcuate configuration and is connected to the axial end 24 of the body on the outer surface of the body. More particularly, the bail is a semicircular hoop having one end forming an enlarged head 36 which in FIG. 1 carries a stud 38 projecting radially inward through a mating hole in the body 12. The other end of the bail has a head 40 which carries a stud 42 shown in FIG. 2 projecting into a mating hole in the body at a position diametrically opposite the stud 38. The bail is dimensioned so that it can swing from a first position extending axially from the end 24 of the body 12 in FIG. 1 and shown in phantom in FIG. 2 to a second position straddling the body at one side as shown in FIGS. 2 and 3. Therefore, the bail is capable of swinging through 90° from the first, extended position to a second position angularly disposed to the longitudinal axis of the body at either side and thus offers a greater degree of flexibility than prior art curlers having integrally connected retaining arms.

As illustrated most clearly in FIG. 3, the mid-section 44 of the bail between two flanges 46 and 48 is straight and serves as a pivot shaft to which the retaining arm 18 is attached to rock or tilt when necessary. The flanges 46 and 48 hold the arm 18 on the mid-section 44 in a longitudinal plane extending through the curler body 12. As shown most clearly in FIGS. 2 and 3, the height or radius of the bail 14 situates the arm 18 in spaced relationship with the adjacent side of the body 12 when the bail is swiveled into the angularly disposed position, and the arm is generally parallel to the longitudinal axis of the body 12. Thus, a tress of hair H which is rolled onto the outer surface of the body is not crushed when it is captured between the arm and body.

The retaining arm 18 has a transverse bore at its midpoint to receive the mid-section 44 of the bail 14 and a slot 50 shown in FIG. 2 penetrates from one side of the arm into the bore and has a slightly smaller dimension than the bore to permit the arm to be snapped onto the mid-section 44. The channels cutting across the arm at each side of the sot 50 provide flexibility to snap the arm onto the mid-section 44 of the bail 14.

A catch formed by a ball detent 52 is mounted on one end of the arm 18 at an extended location by means of a stand-off 54. The detent and stand-off serve as a means for holding the arm parallel with the axis of the body 12 while the arm captures the tress of hair on the body. The detent engages the body through one of the perforations 22; therefore, the size of the detent is selected to be slightly larger than the perforation, as shown most clearly in FIG. 3, so that the ball will snap through the perforation during engagement with or disengagement from the body 12.

A ball detent 56 is also connected to the retaining arm 18 at the end opposite the detent 52 and is mounted on the arm by means of a stand-off 58 having the same length as the stand-off 54. Like the detent 52, the detent 56 is sized to snap through a perforation 22 in the body 12 to hold the retaining arm 18 generally parallel to the longitudinal axis of the body but in spaced relationship with the opposite side of the body. Thus, the retaining arm may be pivoted with the bail 14 to either of two positions at diametrically opposite sides of the body and when the curler 10 is in use, the arm may be swung to the side which is exposed or which is most convenient for capturing a tress of hair H.

The retaining arm 20 at the other axial end 26 of the body is constructed in the same fashion as the arm 18 described above and therefore carries a ball detent 60 on a stand-off 62 at each end as illustrated in FIG. 1. The detents 60 engage a perforation 22 in the body 12 to capture the tress of hair rolled onto the body at the axial end 26. With two such detents capturing the tress of hair at the axial ends 24 and 26 of the body, the curler 10 remains securely in place.

The operation of the curler is relatively simple and efficient. With the bails 14 and 16 and the retaining arms 18 and 20 positioned out of the way adjacent the axial ends 24 and 26 of the body 12 as shown in FIG. 1, a tress of hair is rolled onto the curler without interference from the arms or the bails. With the tress extending around the body as shown in FIG. 3, the retaining arms and the pivotal bails are swung over the respective ends of the body, and the ball detents are snapped through perforations in the body to capture the tress and hold the curler 10 in position. The movement of a retaining arm into the capturing position can be performed with the forefinger while the thumb and remaining fingers hold the curler and hair in place, and the arms are swung to the side of the body 12 which is most convenient for the desired positioning of the curler within the rolled tress. Thus, the curler 10 has a design which facilitates efficient setting of hair.

While the hair curler 10 has been disclosed in a preferred embodiment, it should be understood that numerous modifications and substitutions can be made without departing from the spirit of the invention. For example, the specific design of the bails and retaining arms illustrated permits these parts to be formed by an injection molding process. It is not essential that such a process be used and thus obvious modifications of the parts can be made and materials other than plastic may be utilized. The generally arcuate configuration of the bail may be modified into a more rectangular configuration without affecting the operation of the retaining arms 18 and 20. The ball detent which holds a retaining arm engaged with the body 12 may be replaced by equivalent snap catches or other means for holdng the arms in the desired position. Accordingly, the present invention has been described in a preferred embodiment by way of illustration rather than limitation.

I claim:

1. A hair curler comprising:

a hollow perforated cylindrical body onto which a tress of hair is rolled between opposite axial ends of the body;

a bail pivotally connected to one end of the perforated cylindrical body for swivelling movement between a first position extending axially of said one end and a second position projecting in angularly disposed relationship to the axis of the body;

a retaining arm pivotally mounted on the bail at one end of the cylindrical body for tilting or rocking motion on the bail, the arm being tiltable relative to the bail to assume a position extending from the bail and over the perforated cylindrical body in offset relation to the longitudinal axis of the body when the bail is in the second position to capture a tress of hair rolled onto the body between the body and the retaining arm; and means for holding the retaining arm over the perforated cylindrical body generally parallel to the axis of the body to retain the captured tress of hair around the body.

2. A hair curler as defined in claim 1 wherein the bail is a semicircular hoop attached to diametrically opposite sides of the cylindrical body at the one end.

3. A hair curler as defined in claim 2 wherein the semicircular hoop is attached to the outer sides of the cylindrical body at the one end.

4. A hair curler as defined in claim 1 wherein the retaining arm is mounted at the mid-section of the bail; and the bail is pivotally connected to opposite sides of the body at the one end and is dimensioned to position the retaining arm at the mid-section of the bail in spaced relationship with the body at the second position of the bail.

5. A hair curler as defined in claim 1 wherein the bail is pivotally connected to the cylindrical body at diametrically opposite sides of the body and is dimensioned to permit the bail to swing from the first position axially of the one end of the body to a second position straddling one side of the body at the one end.

6. A hair curler as defined in claim 1 wherein the bail has a generally arcuate configuration with a straight mid-section and the retaining arm is pivotally mounted on the mid-section of the bail.

7. A hair curler as defined in claim 1 wherein the means for holding comprises a snap catch connected to the retaining arm and engageable with the cylindrical body.

8. A hair curler as defined in claim 7 wherein the snap catch comprises a catch mounted on the retaining arm and engageable with a perforation in the cylindrical body.

9. A hair curler as defined in claim 7 wherein:

the retaining arm is pivotally mounted at its midpoint on the bail at the mid-section of the bail; and the one snap catch engageable with the body is connected to the arm at one end of the arm and another snap catch engageable with the body is connected to the arm at the opposite end to permit the arm to be engaged with the body in a position generally parallel to the axis of the body at either of two diametrically opposite sides of the body.

10. A hair curler as defined in claim 1 wherein the one pivotal bail and retaining arm for capturing a tress of hair are mounted at one end of the cylindrical body and another, similar bail and retaining arm for capturing the tress of hair are mounted at the opposite end of the body.

11. A hair curler as defined in claim 1 wherein:

the bail is pivotally connected to one end of the perforated body for swivelling movement between the first position and each of two second positions at diametrically opposite sides of the body; and the retaining arm is pivotally mounted near its midpoint on the mid-section of the bail.

* * * * *